United States Patent [19]

Morgan et al.

[11] 4,328,418

[45] May 4, 1982

[54] MAGNETIC FIELD CORRECTION METHOD AND APPARATUS

[75] Inventors: Hugh T. Morgan, Lyndhurst; Walter Glatz, Walton Hills, both of Ohio

[73] Assignee: Picker Corporation, Cleveland, Ohio

[21] Appl. No.: 138,821

[22] Filed: Apr. 10, 1980

[51] Int. Cl.[3] ..... H01J 31/50

[52] U.S. Cl. ..... 250/213 VT; 313/94

[58] Field of Search ..... 250/213 VT; 313/94

[56] References Cited

U.S. PATENT DOCUMENTS 3,809,889 5/1974 McBroom ..... 250/213 VT

*Primary Examiner*—David C. Nelms
*Assistant Examiner*—Darwin R. Hostetter
*Attorney, Agent, or Firm*—Watts, Hoffmann, Fisher & Heinke Co.

[57] ABSTRACT

Method and apparatus in an x-ray image intensifier tube 22. The invention features an intensifier tube including a photo cathode 24 for generating photoelectrons and a screen 25 for receiving those electrons after they have been accelerated through the length of the intensifier tube. A metallic shield or housing 27, 28, 29 is positioned about the space between photo cathode 24 and screen 25 and a multiturn conductive wire or coil 30 is positioned about the exterior surface of the shield and connected to a source of potential 23. The current through the wire is governed to cancel uniformly the earth's natural geomagnetic field throughout the entire interior region of the evacuated tube. This step reduces image degradation due to forces on the electron as they travel from the photocathode to the screen. Circuitry 38 is included for changing the current as the intensifier tube is re-oriented in the earth's field during x-ray diagnostic procedures.

14 Claims, 10 Drawing Figures

MAGNETIC FIELD CORRECTION METHOD AND APPARATUS

TECHNICAL FIELD

This invention relates generally to x-ray imaging systems and more particularly relates to x-ray image intensifier tubes with compensating S-coils for decreasing adverse effects caused by the earth's naturally occurring magnetic field.

BACKGROUND ART

In a radiography study, an object to be examined, typically a patient is placed between a source of x-rays and a fluorescent screen or photographic film. The x-rays passing through the object produce light photons when they strike the fluorescent screen or silver grains in the developed film.

For a given cross section of fluorescent screen it is possible to calculate a brightness factor which can be expressed in units of light photons per square millimeter per second. This brightness factor could, of course, also be expressed in other equivalent units such as photons per square meter per second. An intensifier is any device which when used in an x-ray system increases the number of light photons produced per square millimeter per second.

It is known that such an intensifier can improve x-ray image brightness thereby enhancing viewing comfort. The reasons for this improvement in x-ray viewing are well documented in the literature, c.f. *Encyclopedia of X-Rays and Gamma Rays* ed. by George C. Clark, Reinhold Publishing Corporation copyright 1963 at page 503.

The principal ingredient in most commonly used intensifier units is an electron tube known by such diverse names as image phototube, image converter, image tube, or image intensifier tube. They all refer to an evacuated envelope which houses apparatus for increasing the brightness of the image generated in response to the x-radiation.

In a typical intensifier, the x-radiation passes through a glass or metal envelope and falls upon an input screen which includes a fluorescent layer. Visible light energy produced by the fluorescent layer passes to a photoemissive layer in the input screen which cause photoelectron emission. The photoelectron density corresponds to the brightness distribution over the fluorescent layer which in turn corresponds to the x-ray intensity over the examined patient area.

At an opposed end of the intensifier tube is positioned an output screen. Application of suitable accelerating potentials to the photoelectrons from the photoemissive layer causes those electrons to strike the output screen. This output screen also includes a fluorescent material layer so again a visible image is generated. In a typical application a 30 kv power supply is used to provide the requisite acceleration.

A number of control electrodes are typically positioned along the acceleration path to cause the image on the output screen to be reduced in size from the image at the input screen. Both input and output screens include conductive layers which when coupled to the power supply separate those screens by a large potential difference. Due to the electrical interaction between the electrons and the electrode/screen combination the image at the output screen is much brighter than an image attained by direct fluroscopy. Brightness enhancement of several orders of magnitude is possible with such a unit. The reduced image may be subsequently enlarged without brightness diminution.

Causing electrons to accelerate between an input screen's electron emissive layer and an output or viewing screen enhances image brightness but at the expense of producing an image anomaly or abberation called S-distortion. S-distortion is caused by a magnetic field exerting a force on the moving electrons inside the intensifier tube. This force causes a straight line in the input image to be imaged as an S-shaped curve at the output image and thus the name S-distortion of S'ing. This same magnetic force also causes the output image to be rotated with respect to the input image. The amount of magnetic distortion (S'ing and image rotation) depends on the magnetic field strength inside the intensifier tube, the orientation of the tube with respect to the magnetic field direction, and the size of the input image. Magnetic distortions are more detrimental to image quality for larger diameter intensifying tubes. With increasing use of larger input screen intensifier tubes the magnetic distortion problem becomes even more significant.

The natural magnetic field associated with the earth is a vector field with the flux lines running from the southern to the northern hemisphere. These lines intercept the earth's surface at an angle called the dip angle. One publication, the Handbook of Chemistry and Physics, lists the horizontal component of the earth's magnetic field vector and the dip angle for various locations around the world.

The force exerted on a charged particle in an electric field ($\overline{E}$) and magnetic field ($\overline{B}$) is given by the Lorentz equation:

$$\overline{F}=\overline{F}\,\text{electric}+\overline{F}\,\text{magnetic}=q\overline{E}+q\overline{v}\times\overline{B} \qquad (1)$$

where q and $\overline{v}$ are the charge and the velocity of the charged particle.

In an intensifier tube the charged particles are electrons which are acted upon an $\overline{E}$ field set-up by the charged electrode structure and an undesirable $\overline{B}$ field from the natural magnetic field about the earth. Since the magnetic force is $$\overline{F}\,\text{magnetic}=\overline{q}\,(\overline{v}\times\overline{B})$$

this force is proportional to the velocity of the electron and the direction of the force is perpendicular to both the velocity and the B field. This is the force that causes the magnetic S'ing distortions in the image.

Suggestions have been made to reduce S'ing and image rotation caused by the earth's magnetic field. One technique use in prior art tubes is the provision of a mu-metal shield around the tube designed to shield the interior from magnetic fields. The shield, in theory, draws the earth's magnetic flux into itself and thus deflects the magnetic flux lines away from the interior of the intensifier tube. The mu-metal shield must be open, however, at the input and output ends of the intensifier tube and therefore some part of the earth's magnetic field enters the tube and results in S-distortion.

A second technique used to reduce S'ing and image rotation also modifies the magnetic field within the tube. One system embodying the second technique is disclosed in U.S. Pat. No. 3,809,889. This patent shows an intensifier tube with a current carrying coil positioned about the exterior of the tube near the input screen. When a current passes through the coil a magnetic field is created in the vicinity of the input screen which tends to cancel the earth's magnetic field at that location.

Tests conducted using the configuration shown in U.S. Pat. No. 3,809,889, however, show that the magnetic field inside the tube is not effectively cancelled along the entire length of the tube. While the field near the input screen is reduced it should be recalled that the force on a moving electron is proportional to its velocity. Thus, as the electron is accelerated away from the U.S. Pat. No. 3,809,889 coil the magnetic side force is again experienced. In fact, the magnitude of this side force increases after the electron has picked up speed along its path toward the viewing screen. It is apparent therefore that the U.S. Pat. No. 3,809,889 arrangement with its S-coil near the input screen inadequately addresses the magnetic distortion problem.

The apparatus disclosed in U.S. Pat. No. 3,809,889 also ineffectively changes the current through its coil as the intensifier tube is re-oriented in the earth's field. The U.S. Pat. No. 3,809,889 apparatus comprises a Hall effect probe which measures changes in magnetic field in proximity to the intensifier tube. The current in the coil is then modified in response to the output of the hall effect device. This technique is inadequate. It is the field inside the tube which causes the distortion and not the field in proximity to the outside of the tube. The intensifier tube housing may disrupt the magnetic field and greatly alter the field on the inside of the tube. It is apparent that the U.S. Pat. No. 3,809,889 apparatus is unsuited to modify the current through its coil as the intensifier tube is re-oriented since the Hall probe is not measuring the correct magnetic field.

DISCLOSURE OF INVENTION

The present method and apparatus overcome inadequacies in prior art magnetic correction techniques by maintaining a nearly uniform magnetic field throughout an entire intensified tube length. Practice of the present invention insures that the electrons in the tube are subjected to a uniform low strength magnetic field along the entire electron acceleration path and not merely in the region where photo electrons are generated.

Apparatus constructed in accordance with the invention includes an X-ray intensifier tube with a photo cathode input screen for receiving the x-rays and generating photon induced electrons, and an output screen for intercepting the electrons after they have been accelerated through a region inside the tube. The magnetic field inside the region is reduced uniformly by a magnetic field altering mechanism so that the S'ing and image rotation phenomena caused by the earth's magnetic field are substantially reduced.

According to a preferred embodiment of the invention the space between photo cathode and output screen is surrounded by a metallic shield which to an extent interrupts and reduces the magnetic field inside the space. The metallic shield is in turn surrounded by a metallic current carrying coil. Current flow in the coil generates a magnetic field inside the tube which opposes the earth's natural magnetic field and further reduces the magnetic intensity inside the intensifier tube.

The coil is preferably a multi-turn wire coil attached to a source of electric potential which produces a current in the coil. The direction of current flow in the coil is determined by the well known right hand rule so that the induced field opposes rather than enhances the naturally occurring field inside the tube.

Coupled to the coil and the source is a control circuit which changes the current flow through the coil thereby changing the magnetic field contribution from the coil when the tube is re-oriented. This adjustability in magnetic field strength permits desired manipulation of imaging systems which utilize intensifier tubes without affecting adversely the quality of an image produced. Imaging systems can be oriented in a variety of positions for x-ray imaging flexibility. As the x-ray apparatus is moved the orientation of the intensifier tube in the environmental magnetic field changes. Since it is the magnetic component perpendicular to the electron velocity that produces the S'ing and image displacement this perpendicular component also changes with tube orientation. The current through the coil is modified to most effectively counter the earth's field for each intensifier tube orientation. If, for example, the earth's distortion causing magnetic field component increases as the tube is tilted the current through the coil must be increased to reduce the net distortion causing magnetic field component.

In the preferred embodiment compensation correction for various intensifier tube orientations is achieved empirically. The tube is oriented to a particular position and one of a series of potentiometers coupled to a coil control circuit are adjusted until S distortion is minimized for that position. The intensifier tube is then reoriented and a second of the series of potentiometers is adjusted to optimize the image. In the preferred embodiment four ranges of intensifier tube positions have been provided so that there are four potentiometers coupled to the control circuit.

From the above it is apparent that one object of the present invention is to modify the magnetic field inside an x-ray intensifier tube to reduce image distortion due to the presence of the earth's magnetic field. A second object is to maintain low magnetic image distortion while allowing the intensifier tube to be re-oriented. Other objects and advantages will become more apparent as a preferred embodiment of the invention is discussed in conjunction with the accompanying drawings.

BEST MODE FOR CARRYING OUT THE INVENTION

Figure 1:
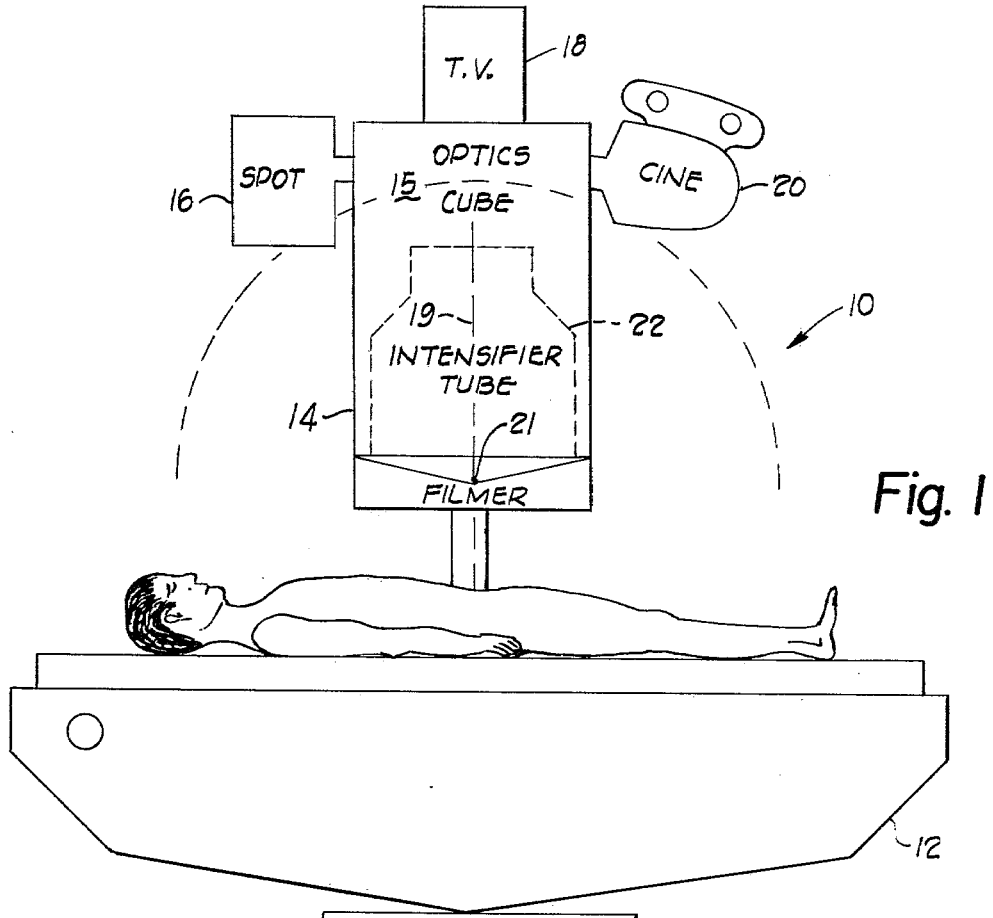
FIG. 1 shows a schematic side view of an x-ray imaging system employing an x-ray image intensifier tube.

Turning now to the drawings and in particular FIG. 1, an x-ray imaging system 10 is shown. The imaging system 10 includes a patient support 12 coupled to an intensifier tube housing 14. The housing is in turn coupled to an optics cube 15 which includes a beam splitter 13 (see FIG. 2) for transmitting x-ray images of a patient to anyone of three viewing mechanisms. In the disclosed system the optics cube 15 is coupled to a spot camera 16, a TV camera 18 and a cine camera 20.

A source of x-radiation positioned beneath the patient transmits x-radiation through the patient to the intensifier tube housing 14. Inside the housing an intensifier tube constructed in accordance with the invention enhances the image transmitted to the cube 15. The patient support and intensifier tube housing may be rotated at about an axis 21 to allow a repositioning of the patient for a variety of studies. The axis 21 is perpendicular to the plane of FIG. 1. The system 10 is coupled to a drive mechanism (not shown) for reorienting the patient support 12 and the intensifier tube housing by rotating the two about the axis 21. Typically such rotation is possible through a full 180° with the patient in a vertical orientation at the extremes of such rotation.

Figure 2:
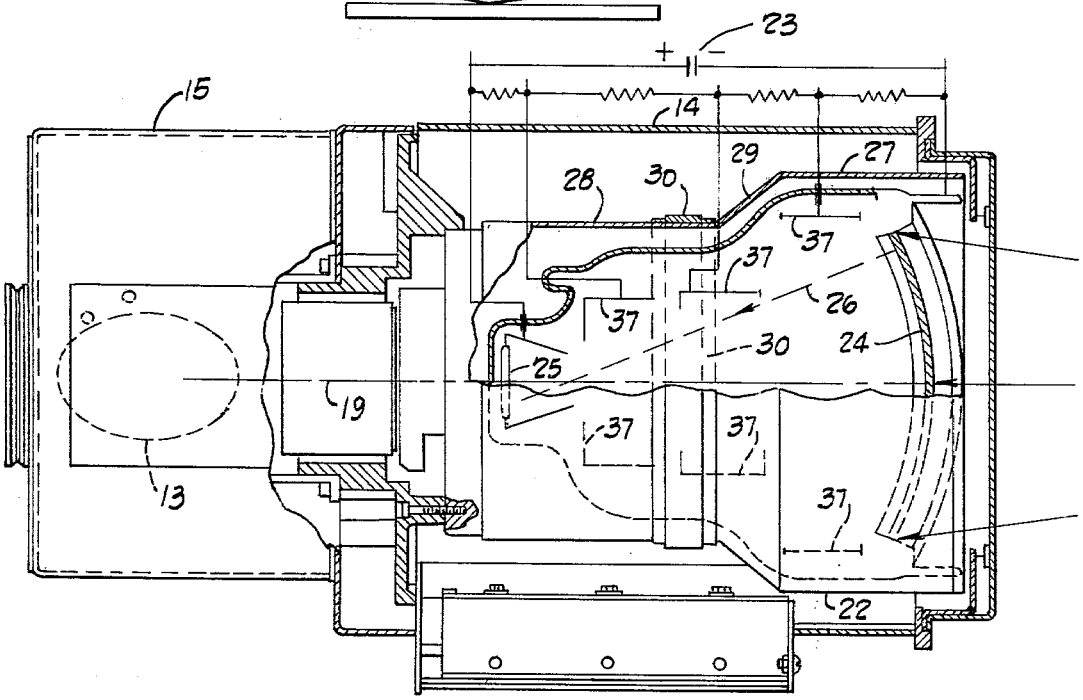
FIG. 2 is a plan view of an intensifier tube housing, partially sectioned to show the intensifier tube and a distortion reducing coil.

Positioned inside the intensifier tube housing 14 is an intensifier tube 22 (FIG. 2) which includes a photocathode 24 at an input end and a viewing or output screen 25 located at an opposed output end of the intensifier tube 22. As seen in FIG. 2, the cathode 25 has an outside diameter substantially larger than the viewing screen 25. A typical acceleration path 26 for a photoelectron has also been shown. In a region intermediate the photocathode and viewing screen photoelectrons produced by incident radiation accelerate due to an accelerating potential provided by a high voltage source 23 of approximately 30 kilovolts. Such a source has been shown schematically coupled to the cathode 24 and screen 25 shown in FIG. 2. The source 23 is also coupled to a series of electrodes 37 positioned inside the tube 22 which shape the electron acceleration path.

Positioned approximately midway between the photocathode 24 and the viewing screen 25 is a current carrying coil 30 which diminishes the adverse effects caused by the earth's naturally occurring geomagnetic field. The coil is coupled to a source of electrical potential which in turn is coupled to control circuitry 38 (FIG. 9) which modifies the current in the coil in response to changes in orientation of the intensifier tube as it is rotated about the axis 21.

The intensifier tube 22 forms a cylindrical body with two different outside dimensions. A first intensifier tube portion 27 has a relatively large outside diameter to house the large cathode diameter. A second tube portion 28 has a smaller diameter to house the smaller diameter of the tube at the screen output end. An intermediate portion 29 is tapered to couple the larger first portion 27 with the more narrow second portion 28. The coil 30 has an inside diameter which fits over the more narrow portion 28 and allows the coil to abut the intermediate portion 29.

The tube exterior comprises a high permeability ferromagnetic shield which provides some attenuation of the earth's magnetic field and in combination with the coil 30 effectively reduces the magnitude of the magnetic field inside the tube thereby reducing image distortion. The shield may also be sandwiched between an aluminum outside layer and an interior layer of lead. In the preferred embodiment of the invention the shield comprises a nickel/cobalt alloy which due to its ferromagnetic properties attenuates the field inside the tube 22.

Figure 4:
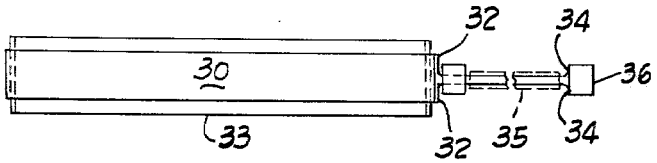
FIG. 4 is a side view of the distortion reducing coil of FIG. 2 coupled to a contact housing.
Figure 5:
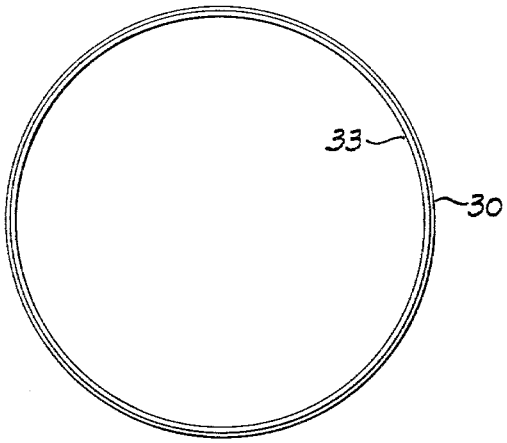
FIG. 5 shows an end view of the coil and a core tube which supports the coil.

As seen most clearly in FIGS. 4 and 5 the coil comprises a cylindrical winding of wires which may be slipped over an already existing intensifier tube and coupled to the control circuitry 38. The coil 30 is a continuous single winding and in the preferred embodiment comprises approximately 140 turns of No. 26AWG magnet wire which terminate in two leads 32.

In constructing the coil the wire is deposited about a core tube 33. According to one technique for constructing the coil 30 the wire is secured to the core tube, in three separate layers. One end of the wire is attached to the tube 33 with tape and the first layer is wound about the tube and cemented in place using an appropriate cementing material such as glyptal cement in such quantity as required. After the cement has dried a second layer of an approximately equal number of turns is applied to the first layer and cemented in place. Finally, a third layer is applied to an identical manner and again cemented in place.

The two leads 32 are cut to an appropriate length and trimmed for connection to two pins 34 in a contact housing 36. The length of the leads between the housing 36 and the coil 30 is protected by a flexible tubing 35.

Figure 3:
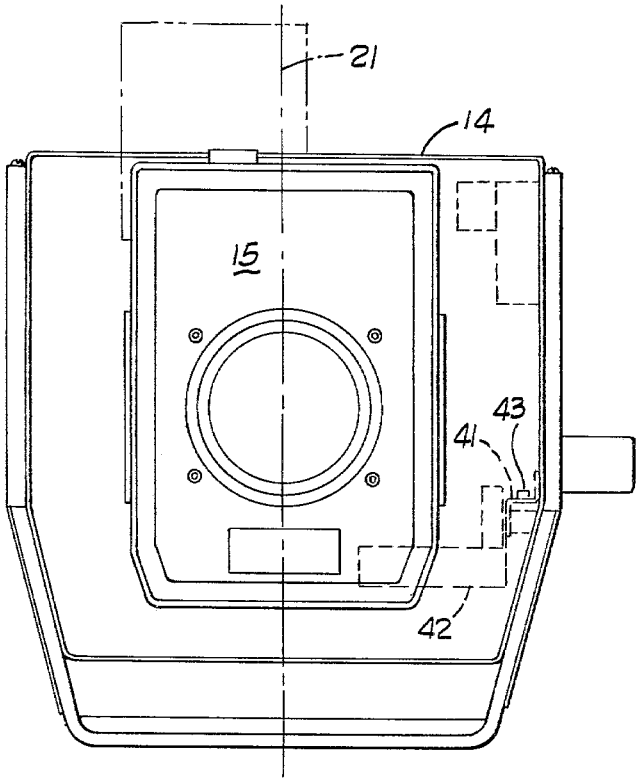
FIG. 3 is an end view of the housing shown in FIG. 2 which also shows an orientation control circuit housing in phantom.

The control circuitry 38 is coupled to the contact housing 36 and monitors the position of an orientation indicator 40 mounted in proximity to the intensifier tube. The control circuitry 38 and orientation indicator 40 are both mounted inside an indicator housing 42 (see FIG. 3). A housing mounting bracket 41 couples the indicator housing 42 to the intensifier tube housing 14 by suitable connectors 43.

As the indicator 40 changes orientation in relation to the housing 42 this change is sensed by the circuitry 38. This circuitry 38 then causes the voltage across the leads 32 to change thereby altering the current through the coil 30. The change in current results in a change in the magnetic field in the intensifier tube. Thus, for different orientations the correction field generated by the coil is changed to produce the best intensifier tube image.

Figure 6:
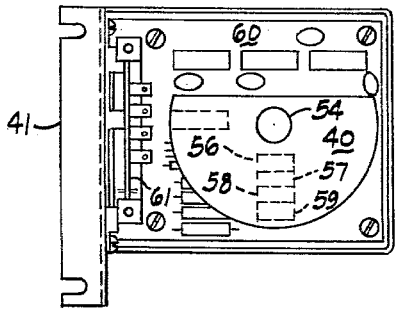
FIG. 6 is a side elevational view of an orientation indicator mounted in proximity to a series of orientation sensors.
Figure 7:
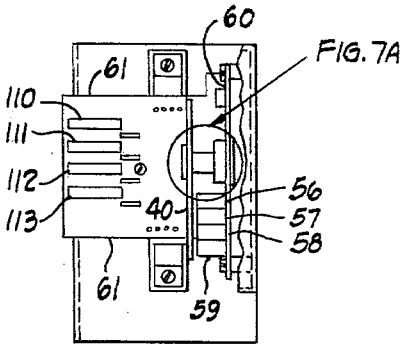
FIG. 7 is an end view of the indicator shown in FIG. 6.

The orientation indicator 40 comprises a plate with a number of reflective areas or regions 50–53 positioned about an aperture 54. As seen most clearly in FIGS. 6, 7, and 7A, the plate 40 is mounted in proximity to four reflective object sensors 56–59 that indicate which of the reflective areas is positioned below the aperture 54 as the intensifier tube orientation is changed.

Figure 7A:
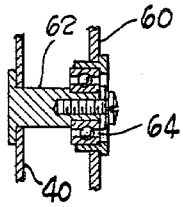
FIG. 7A shows a bearing which couples the indicator to a printed circuit board.

As seen most clearly in FIG. 7A, the indicator 40 is mounted to a printed circuit board 60 by a threaded stud 62 which coacts with a bearing 64. The stud 62 and attached indicator 40 are free to rotate in the bearing 64 as the orientation of the intensifier tube housing is changed as the tube rotates about the axis 21. Since the center of gravity of the indicator 40 is below the bearing, rotation of the housing 42 and sensors 56–59 reorients the indicator with respect to those sensors. In the orientation shown in FIG. 6 a reflective area 52 is in close proximity to an associated reflective sensor 58. When the circuitry 38 is powered this sensor 58 generates control signals which in turn cause a particular coil current appropriate for that orientation to flow through the coil 30 thereby cancelling the earth's magnetic field. As the orientation of the intensifier tube housing is changed other of the reflective surfaces pass over corresponding other of the reflective sensors and transmit signals to the control circuitry 38 to cause a modification in the current passing through the coil 30.

Figure 9:
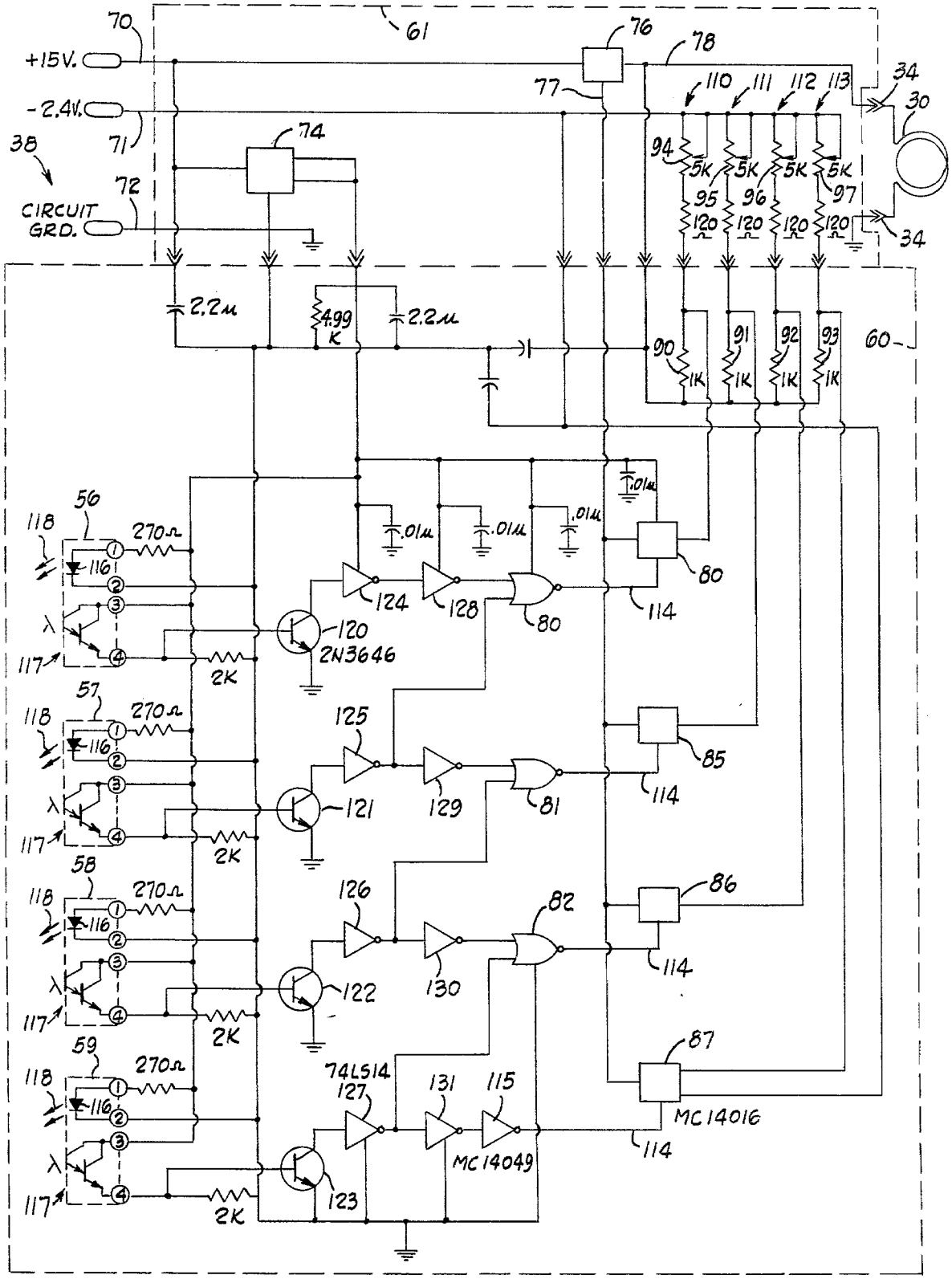
FIG. 9 is a schematic of a control circuit coupled to the sensors for controlling the electrical current through the coil.

FIG. 9 illustrates the preferred control circuit 38 which in combination with the sensors 56–59 causes the current through the coil 30 to be modified in response to changes in intensifier tube orientation. The circuitry is mounted to two printed circuit boards 60, 61. The first printed circuit board 60 mounts the orientation indicator 40 as well as a number of logic circuits to be described hereinafter. The second printed circuit board 61 has three inputs 70–72 which provide a system ground, a −2.4 volt DC signal and an unregulated positive potential of approximately 15 volts. The design and structure of power supplies, suitable for generating such signals is known within the art.

The 15 volt DC and ground inputs are coupled to a 5 volt power supply 74 which in the preferred embodiment comprises a Model 78MG National Semiconductor 5 volt power supply. This power supply is coupled to logic circuitry mounted on the first printed circuit board 60. A voltage regulator 76 is also coupled to the 15 volt unregulated input 70. The preferred voltage regulator 76 comprises a Model LM-317T National Semiconductor voltage regulator. In addition to the 15 volt unregulated input, the regulator 76 has a control input 77 and a controlled output 78. The controlled output 78 is coupled to a pin 34 on the contact housing 36 and therefore transmits a control voltage to the coil 30. The second pin 34 on the contact housing is grounded.

As should be apparent to those skilled in the art, modification of the control input 77 on the voltage regulator 76 will modify the current passing through the coil 30 which in turn will change the magnetic field characteristics in the region in proximity to the coil and in particular in the region between the intensifier tube photocathode 24 and the viewing screen 25. The circuitry coupled to the second printed circuit board 61 which in turn is coupled to the four reflector sensors 56–59 achieves this control by regulating the input 77.

Connected to the first printed circuit board 60 are the four reflective sensors 56–59, three gates 80–82, four analog switches 84–87, and four discrete resistors 90–93. The discrete resistors 90–93 in conjunction with four variable resistors 94–97 mounted on the other printed circuit board 61 form four voltage dividers 110–113. The analog switches 84–87 selectively transmit a voltage input from the voltage dividers 110–113 to the voltage regulator control input 77 in response to a "high" control voltage appearing at a control input 114. The control input 114 to three of four analog switches is generated by the logic gates 80–82 which in the preferred embodiment of the invention comprise NOR gates. The control input to a fourth analog switch 87 is coupled to an inverter 115.

The state (high or low) of the four control inputs 114 is dependent on the orientation of the indicator 40 in relation to the reflective sensors 56–59. Each sensor generates a light signal 118 from a light emitting diode 116 which is transmitted from the sensor and reflects off any surface in proximity to the sensor. Each sensor also includes a detecting follower circuit 117 which receives reflected light and generates a control signal as an output on pin number 4 of that sensor. If the light impinging on the circuit 117 is of great enough intensity the sensor will generate an output at pin 4 large enough to turn on an associated one of four switching transistors 120–123. The distance between the sensor and the indicator 40 is such that light signals 118 from a sensor turn on an associated transistor only when an associated reflective area is opposite that sensor. Thus a first sensor 56 turns on its associated transistor 120 when an associated reflective surface 50 is beneath the aperture and therefore opposite that first sensor 56.

Interposed between the sensor outputs and the NOR gates are the four switching transistors 120–123, four schmitt trigger circuits 124–127, and four inverters 128–131. The manufacturer part numbers for these elements are shown in FIG. 9. When the output from a particular sensor turns on a transistor, the voltage across the turned on transistor is about 1.2 volts and is coupled to the input of an associated schmitt trigger. The schmitt trigger generates a "high" output of about 4.5 volts in response to this 1.2 volt input. The outputs from the schmitt triggers are coupled to the inverters 128–131 and NOR gates as shown in FIG. 9.

A specific illustration will show the interaction between the sensors and the logic circuitry. Assume that a first reflective region 50 is positioned directly opposite its associated sensor 56. That sensor 56 generates an output sufficient to turn on its associated switching transistor 120 and in turn generate a high output from the first schmitt trigger 124. All other schmitt triggers 125–127 generate low outputs since their outputs are coupled to turned off transistors 121–123. In this situation the first inverter 128 has a low output and in combination with the low output from the second schmitt trigger 125 produce a high output from the first NOR gate 80. This causes the first voltage divider 110 to dictate current through the coil by transmitting a voltage from the first voltage divider 110 to the control input 77.

Figure 8:
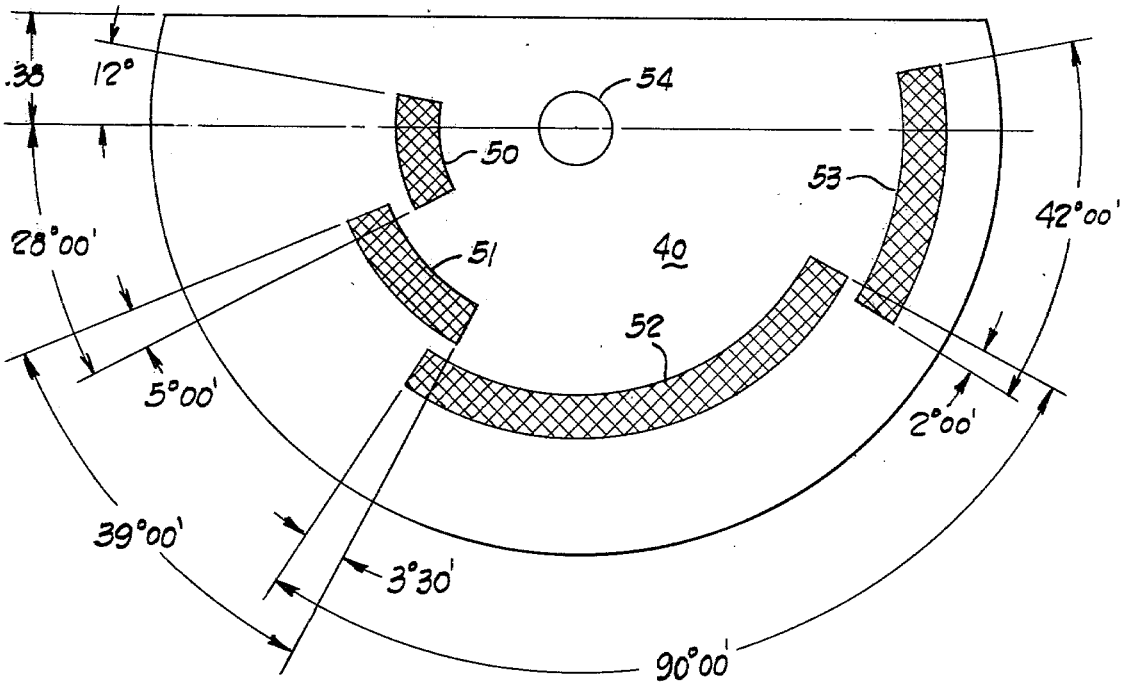
FIG. 8 is an elevational view of the indicator of substantially greater scale than shown in FIG. 6.

As the drive mechanism re-orients the intensifier tube 22 the relative position between the sensors 56–59 and indicator 40 changes. As seen in FIG. 8 there is a degree of overlap in reflective area coverage. Thus there is an orientation where the first sensor 56 is opposite its reflective area 50 and the second sensor 57 is also opposite its reflective area 51. The first two transistors 120, 121 are on and it should be apparent to those skilled in the art that the combination of schmitt triggers, inverters and NOR gates transmit a high input to the second analog switch 85. The second analog switch is closed allowing the voltage on the second voltage divider 111 to be coupled to the input 77 thereby controlling coil current. As rotation about the axis 21 continues the first transistor 120 turns off but this has no affect on the inputs to the two first analog switches 84, 85 since the output from the first NOR gate 80 was already low.

The overlapping of reflective areas 50–53 assures that at least one sensor 56–59 is producing enough output at all times to turn on at least one of the switching transistors 120–123. This feature coupled with the schmitt triggers and logic circuitry insures that one and only one analog switch is activated. The combination of schmitt triggers and gates also provides a hysteresis operation which prevents the current through the coil 30 from oscillating from one current state to another as the system 10 is stationary but near a current crossover point.

The coil current control is calibrated empirically. The apparatus 10 is rotated until one sensor is directly over the midpoint of its associated reflective area. A sample mesh pattern is then irradiated and viewed through the T.V. camera, for example, and one of the four variable resistors 94–97 is adjusted until the S distortion has been minimized. If, for example, the first sensor 56 is positioned above its associated area 50, then the first variable resistor 94 is adjusted to minimize the distortion. When this is achieved it is assumed the current in the coil is appropriate to counteract the earth's field.

The calibration procedure is repeated for each of the four sensor/region pairs. It should be appreciated that while the disclosed embodiment of the invention has four sensors if greater sensitivity in control is needed a larger number could be used. It should also be appreciated that the extent of angular coverage for a particular reflective region may also be varied. Thus, the indications of angular coverage and overlap shown in FIG. 8 may be altered to improve performance of a particular X-ray imaging system.

It has been found that while practicing the present invention a particular orientation of the apparatus 10 with respect to the earth's magnetic field is desirable. The apparatus 10 should be positioned so that the axis of rotation 21 is parallel to the horizontal component of the earth's naturally occurring geomagnetic field. In this orientation the earth's magnetic field vector has no horizontal component in the plane of rotation and therefore the component of magnetic field parallel to an intensifier tube axis 19 varies according to the relation B sin $\theta$ where B is the magnitude of the vertical component of the earth's magnetic field and theta is the angle between the horizontal and the intensifier tube axis 19. For the above desired orientation the magnetic field correction method is simplest.

When the axis of relation 21 of the system 10 is nonparallel to the horizontal component of the earth's magnetic field, the metallic housing is less effective at shielding the interior of the intensifier tube 22 from the distortion causing environmental magnetic field and a relatively more complicated correction method (i.e. higher coil currents and more current positions) is required.

While the preferred embodiment of the invention has been described with considerable detail, it is to be understood that the invention may be otherwise embodied and it is the intention to cover all modifications thereof which come within the spirit or scope of the appended claims.

We claim:

1. Apparatus comprising an x-ray intensifier tube including an input end for receiving x-radiation, a photo cathode for producing photoelectrons in response to the x-radiation, output means positioned at an output end of said tube for producing visible light in response to detection of said electrons, means for accelerating the photoelectrons along a path from the cathode to the output means, and magnetic field altering means positioned near a midpoint of said path to provide substantially uniform magnetic field densities along said path.

2. The apparatus of claim 1 wherein the altering means comprises a plurality of conductor windings circumscribing said path and coupled to a source of electric current.

3. The apparatus of claim 1 or 2 wherein the apparatus further comprises shielding means positioned about the intensifier tube for attenuating the natural geomagnetic field within said tube.

4. The apparatus of claim 2 wherein the electric current provided by the source can be varied in a manner dependent on the tube orientation in the earth's natural geomagnetic field.

5. A method for intensifying x-ray images comprising the steps of:

(a) sensing the position of x-rays on a photo cathode by generating photoelectrons whose density corresponds to the x-ray intensity;

(b) accelerating said photoelectrons through a space to a screen to provide a visible image of said x-ray distribution; and (c) providing a uniform magnetic field to the space thereby reducing image degradation due to the presence of the earth's natural geomagnetic field.

6. The method of claim 5 wherein the providing step comprises placing a conductor of generally circular form about the acceleration path of said photoelectrons at a position approximately midway between the photo cathode and the screen and passing a current therethrough to provide a magnetic field in opposition to the earth's geomagnetic field.

7. The method of claim 6 wherein the current through said conductor is varied for different orientations of the cathode and screen.

8. The method of claim 6 wherein the providing step further comprises placing a metallic shield about the space between cathode and screen and wherein the conductor is positioned about the exterior surface of said shield.

9. In an x-ray image intensifying tube a photo cathode for converting x-radiation to photoelectrons, a screen for receiving accelerated photoelectrons from the cathode and converting said photoelectrons to visible light energy, a housing in which the cathode and screen are positioned; and a source of electrical potential for accelerating the photoelectrons toward the screen; the improvement comprising a coil of conductive material coupled to the housing at a position midway between the cathode and screen; said conductor electrically connected to a source of electrical potential to cause current to pass through said coil thereby providing a magnetic field to the interior of said housing in opposition to a component of the earth's natural geomagnetic field perpendicular to the direction of photoelectron movement.

10. The apparatus of claim 9 wherein the coil comprises a multi-winding conductor and which further comprises circuitry coupled to the source for modifying the current through said windings as the orientation of the tube in the earth's field is varied.

11. A control for use in combination with an X-ray intensifier tube comprising:

(a) a current carrying coil positionable about said tube for reducing the magnetic field inside the tube;

(b) an adjustable source of electric potential coupled to the coil to provide current flow through said coil;

(c) orientation sensing means connected to the tube for sensing the orientation of said tube in relation to the earth's magnetic field and for generating a control output in response to said orientation; and (d) control circuitry coupled to said source and said sensing means for adjusting the current through said coil in response to the control output.

12. A method for reducing magnetic field image distortion in an x-ray image intensifier tube comprising the steps of:

(a) encircling the tube with a current carrying coil;
(b) coupling the coil to a variable source of electrical potential;
(c) sensing the orientation of the tube in the earth's magnetic field; and
(d) varying the current through said coil in response to said sensing step to minimize the image distortion.

13. The method of claim 12 which further comprises a calibration step of orienting the tube in a number of orientations in the earth's field and viewing an image produced by said tube in each orientation to ascertain a proper current to apply in each of the orientations.

14. Apparatus comprising an x-ray intensifier tube including an input end for receiving x-radiation, a photo cathode for producing photoelectrons in response to the x-radiation, output means positioned at an output end of said tube for producing visible light in response to detection of said electrons, means for accelerating the photoelectrons along a path from the cathode to the output means, a ferromagnetic shield or housing positioned about said path, and magnetic field altering means positioned near a midpoint of said path to provide substantially uniform magnetic field densities along said path.

* * * * *

UNITED STATES PATENT AND TRADEMARK OFFICE

CERTIFICATE OF CORRECTION

PATENT NO. : 4,328,418

DATED : May 4, 1982

INVENTOR(S) : Hugh T. Morgan and Walter Glatz

It is certified that error appears in the above—identified patent and that said Letters Patent is hereby corrected as shown below:

Column 2, line 12, change "of" to --or--;
Column 2, line 41, after "upon" insert --by--;
Column 3, line 25, change "hall" to --Hall--;
Column 5, line 13, change "anyone" to --any one--;
Column 5, line 34, change "25" to --24--.

Signed and Sealed this

*Thirteenth* Day of *July 1982*

[SEAL]

*Attest:*

GERALD J. MOSSINGHOFF

*Attesting Officer*

*Commissioner of Patents and Trademarks*